US008347588B2

(12) United States Patent
Oh

(10) Patent No.: US 8,347,588 B2
(45) Date of Patent: Jan. 8, 2013

(54) COMPRESSIBLE MATTRESS FRAME

(75) Inventor: Suk Kan Oh, Xiamen (CN)

(73) Assignee: Zinus, Inc., Hayward, CA (US)

( * ) Notice: Subject to any disclaimer, the term of this patent is extended or adjusted under 35 U.S.C. 154(b) by 720 days.

(21) Appl. No.: 11/809,667

(22) Filed: May 31, 2007

(65) Prior Publication Data

US 2007/0283668 A1 Dec. 13, 2007

(30) Foreign Application Priority Data

Jun. 1, 2006 (CN) ..... 2006 2 0060015 U

(51) Int. Cl.
*B65B 63/04* (2006.01)

(52) U.S. Cl. ..... 53/429; 53/116; 53/432; 53/510; 5/620

(58) Field of Classification Search ..... 53/432, 53/399, 429, 116, 510; 5/420, 655, 451, 5/620

See application file for complete search history.

(56) References Cited

U.S. PATENT DOCUMENTS

| | | | | | |
|---|---|---|---|---|---|
| 3,521,424 | A * | 7/1970 | Wirfel | 53/419 |
| 3,735,432 | A | 5/1973 | Kreten et al. | 5/348 |
| 4,076,246 | A * | 2/1978 | Meyer | 273/404 |
| 4,517,692 | A * | 5/1985 | Vogel | 5/680 |
| 4,673,452 | A * | 6/1987 | Awdhan | 156/254 |
| 4,928,337 | A * | 5/1990 | Chauncey | 5/722 |
| 5,115,526 | A | 5/1992 | Boyd | 5/680 |
| 5,259,079 | A * | 11/1993 | Visser et al. | 5/685 |
| 5,937,465 | A * | 8/1999 | Carew et al. | 5/732 |
| 5,960,496 | A * | 10/1999 | Boyd | 5/722 |
| 5,963,998 | A * | 10/1999 | Carew et al. | 5/655 |
| 6,199,230 | B1 * | 3/2001 | Parikh | 5/420 |
| 6,463,605 | B2 * | 10/2002 | Swagger, Jr. | 5/420 |
| 6,792,631 | B1 * | 9/2004 | Hayden | 5/417 |
| 6,901,722 | B2 * | 6/2005 | Dextraze et al. | 53/399 |
| 6,952,906 | B2 * | 10/2005 | Nelson | 53/434 |
| 7,165,282 | B2 | 1/2007 | Watson | 5/739 |
| 2002/0088053 | A1 * | 7/2002 | Swagger, Jr. | 5/420 |
| 2002/0178503 | A1 * | 12/2002 | Reeder et al. | 5/690 |
| 2006/0031995 | A1 * | 2/2006 | Barkhouse | 5/690 |

* cited by examiner

*Primary Examiner* — Thanh Truong
(74) *Attorney, Agent, or Firm* — Imperium Patent Works; Darien K. Wallace

(57) ABSTRACT

A mattress frame that occupies a small volume and can be used by a recipient without having to assemble the frame. The frame has four connected sides and is made of foam. The frame is rectangular in shape and has two longer sides and two shorter sides. The two shorter sides are folded in a U shape so that a bow-tie-shaped frame results. The bow-tie-shaped frame is rolled and packaged in a container. The frame can be rolled to form a spiral or an M-shape. A recipient of the rolled frame removes the frame from its packaging and the frame expands to its intended shape.

19 Claims, 6 Drawing Sheets

(TOP VIEW)

(PERSPECTIVE VIEW)

(TOP VIEW)

(PERSPECTIVE VIEW)

(PERSPECTIVE VIEW)

COMPRESSIBLE MATTRESS FRAME

CROSS REFERENCE TO RELATED APPLICATION

This application is based on and hereby claims the benefit under 35 U.S.C. §119 from Chinese Patent Application No. 200620060015.8, filed on Jun. 1, 2006, in China, the contents of which are hereby incorporated by reference. This application is a continuation-in-part of Chinese Application No. 200620060015.8.

TECHNICAL FIELD

The present invention relates generally to mattresses, and more particularly to a compressible frame for a mattress.

BACKGROUND

New types and forms of mattresses and mattress accessories continue to be developed for traditional bedroom use, as well as for such diverse uses as camping, boating and recreational vehicle traveling. For example, some mattresses provide support against weight using springs, some mattresses are filled with air, some mattresses are filled with water, whereas some mattresses are made of memory foam or have a layer of memory foam to provide support against weight.

When weight is applied against an edge of a mattress, the mattress deforms and does not provide support. Mattress deformation is particularly a problem for air mattresses. Rigid frames that surround the mattress are used to provide support at the edges of a mattress and provide support against weight placed at the edge of a mattress.

FIG. 1 (prior art) is a perspective view of a prior art frame structure used to support edges of a mattress. The frame attachment structure includes first side 10, second side 12, third side 14 and fourth side 16. First side 10 and third side 14 are substantially the same in size and second side 12 and fourth side 16 are substantially the same in size. The first side 10, second side 12, third side 14 and fourth side 16 are made of a foam material. A cloth 20 or other material such as plastic is affixed to each of first side 10, second side 12, third side 14 and fourth side 16 so that each side stays in place relative to other sides. The first side 10, second side 12, third side 14 and fourth side 16 provide a frame for a mattress. For example, the mattress would be placed underneath cloth 20 so that if no other cover is used, a person would contact cloth 20 when sitting on the mattress.

To package the frame structure of FIG. 1 for shipping, the sides are folded inward but maintain a connection with cloth 20. The resulting structure has both length and width larger than a size of the mattress it is to surround, which can consume too much space during transportation.

One drawback with this frame structure of FIG. 1 is that the frame is bulky and takes up more space than desired during transportation. It is desirable to minimize the size of goods during transportation in order to reduce costs and increase the amount of goods that can be transported. In addition, the process of mounting the sides to cloth 20 can be complicated, and gaps are present in the frame so that the evenness of support of edges of a mattress may not be acceptable to a user.

FIG. 2 (prior art) is a perspective view of another prior art frame structure. The frame structure includes first side 10, second side 12, third side 14 and fourth side 16. In this structure, however, four replicas of corner 24 are used so that sides are set in place. Each corner 24 has two inlets and each inlet receives a side so that sides are formed ninety (90) degrees from each other. The mattress is placed inside the boundaries of the sides.

To package the frame structure of FIG. 2 for transporting, the sides are disconnected from each corner 24 and the sides are placed together and separate from the corners. The resulting structure that is to be shipped has a length larger than a size of the mattress it is to surround, which can consume too much space during transportation.

One drawback with the frame structure of FIG. 2 is that it consumes too much space during transportation. In addition, the user of the frame has to construct the frame, which may dissuade customers from purchasing the frame. In addition, the frame does not provide uniform support to edges of a mattress because there are different widths of material used to surround a mattress.

SUMMARY

The following presents a simplified summary of some embodiments of the invention and is not intended to delineate the scope of the invention. This summary presents some embodiments in a simplified form as a prelude to the more detailed description that is presented below.

One embodiment includes a compressible mattress frame that can be packaged into a small volume so that it consumes a small volume during transportation. According to one aspect, the frame is formed by injecting chemicals into a mold to form a continuous piece of rigid foam material in the shape of a rectangle. The dimensions of the mold depend on the size of the mattress the frame is to surround. The rigid foam material can be polyurethane foam. In another aspect, the frame is formed by forming a rectangular strip of rigid foam, cutting the strip into four pieces such that each of the four pieces is a side of the frame and then bonding the edges of the pieces together so that the resulting structure is a rectangle shaped frame. In one aspect, the bonding uses an adhesive such as, but not limited to, urethane-based glue.

In accordance with another embodiment, the frame structure is compressed so that it takes minimal space during transportation. The shorter sides of the frame are pushed inward from the middle of the shorter sides and the longer sides of the frame are pushed inward so that the resulting structure is bow-tie shaped and has the shorter sides bent in half with each inner portion of the half of the shorter side touching an inner portion of the longer side of the frame. The bow-tie shaped structure is then rolled and compressed and vacuum packed into a plastic cover. The recipient of the frame can remove the rolled and compressed frame from the cover and the shape of the frame restores to a rectangle. The frame can then be placed to surround a mattress. The support provided to edges of a mattress is consistent because the same thickness of material and type of material is used around the frame.

Accordingly, a frame is provided that involves no assembly by a user and compresses into a small shape so that it uses little space during transportation.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
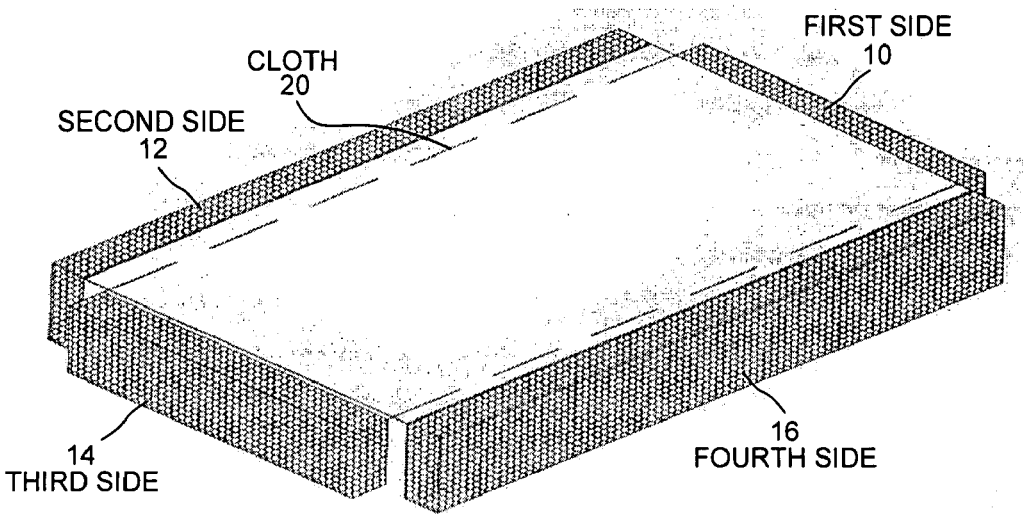
(PRIOR ART) FIG. 1
FIG. 1 (prior art) is a perspective view of a prior art frame structure.
Figure 2:
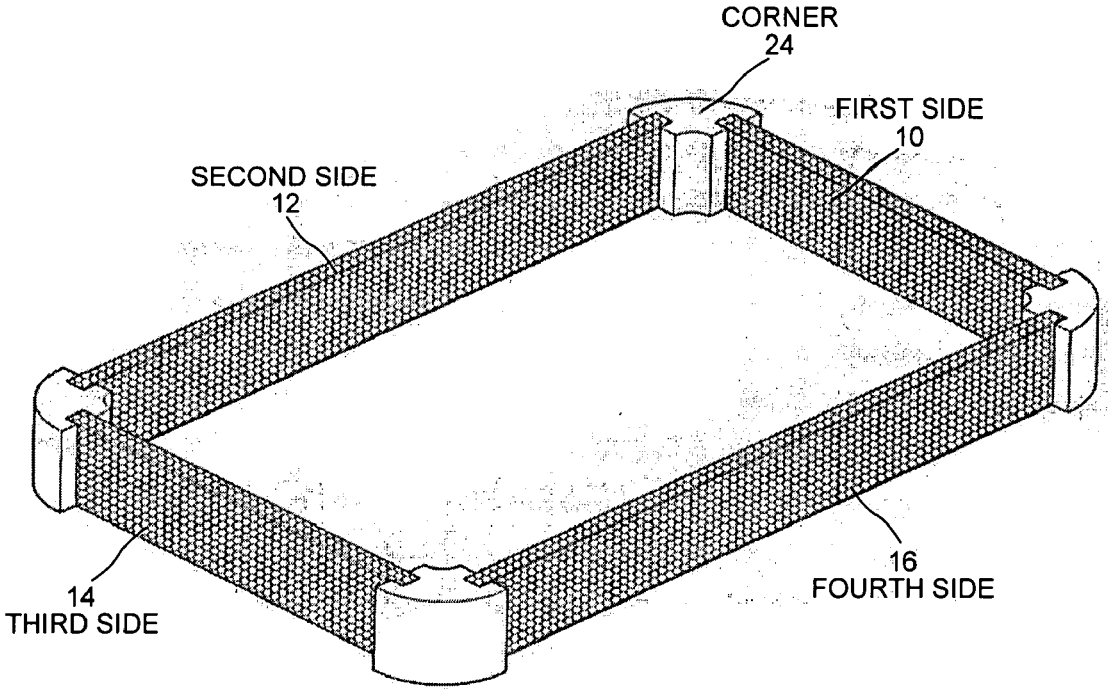
(PRIOR ART) FIG. 2
FIG. 2 (prior art) is a perspective view of another prior art frame structure.
Figure 3:
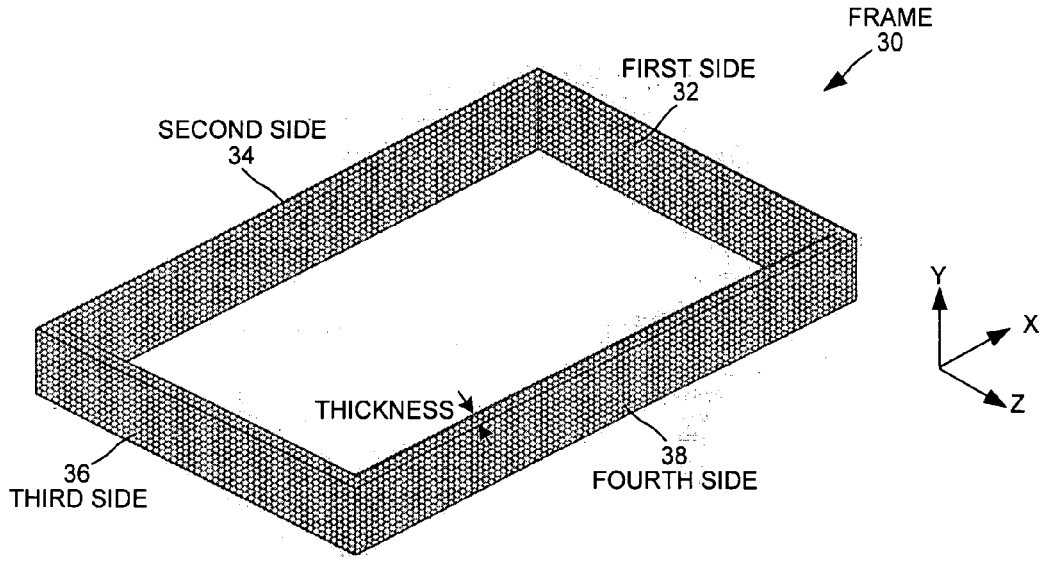
FIG. 3 is a perspective view of a frame in accordance with an embodiment.
Figure 10:
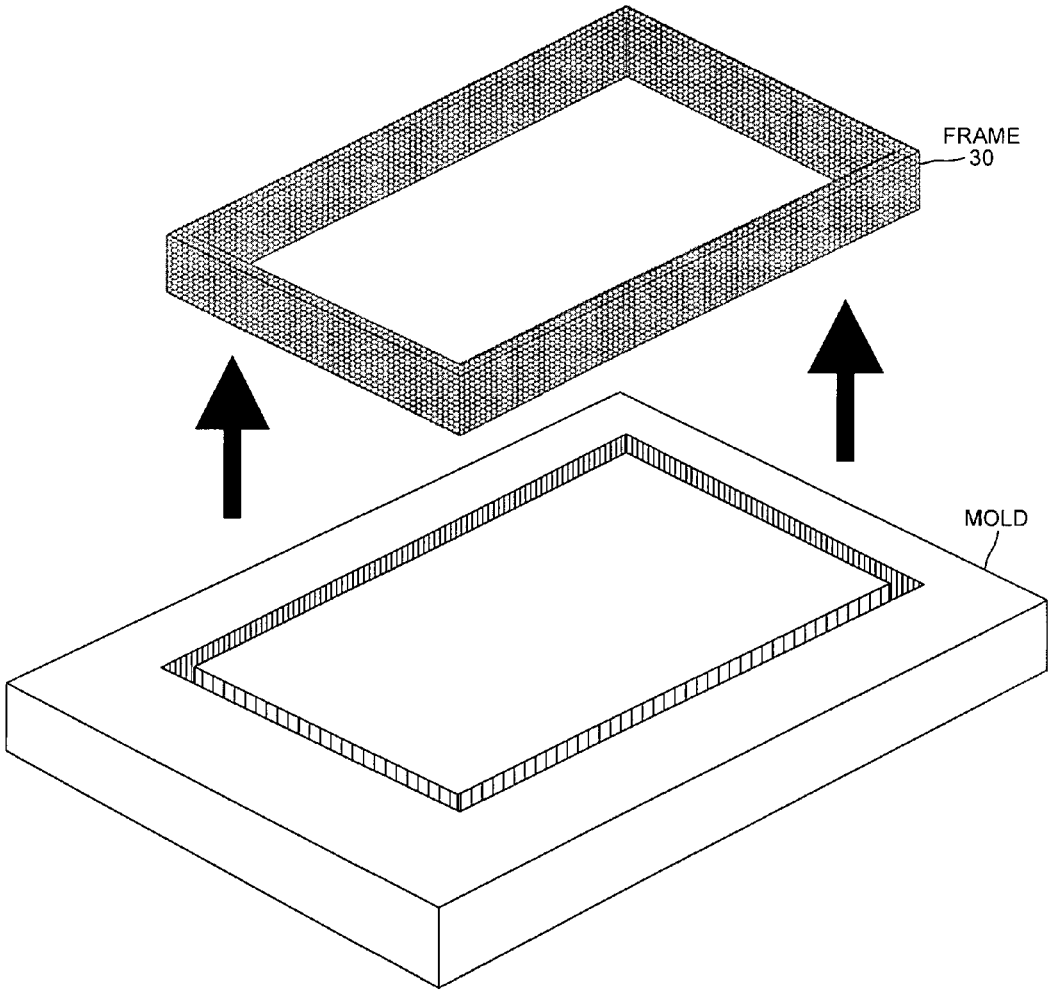
FIG. 10 is a perspective view of the frame of FIG. 3 and a mold in accordance with an embodiment.

FIG. 3 is a perspective view of a frame 30 in accordance with an embodiment. Frame 30 is formed to be a rectangular shape having four sides and an opening in the center for insertion of a mattress by injecting chemicals into a mold, such as a mold shown in FIG. 10. In one aspect, the mold produces a frame 30 made of a polyurethane foam. For example, the foam can have a density of approximately 0.8-3.0 pounds per cubic foot. The resulting frame 30 has a first side 32, a second side 34, a third side 36 and a fourth side 38. In this embodiment, frame 30 is shaped without joining individual sides.

Figure 4:
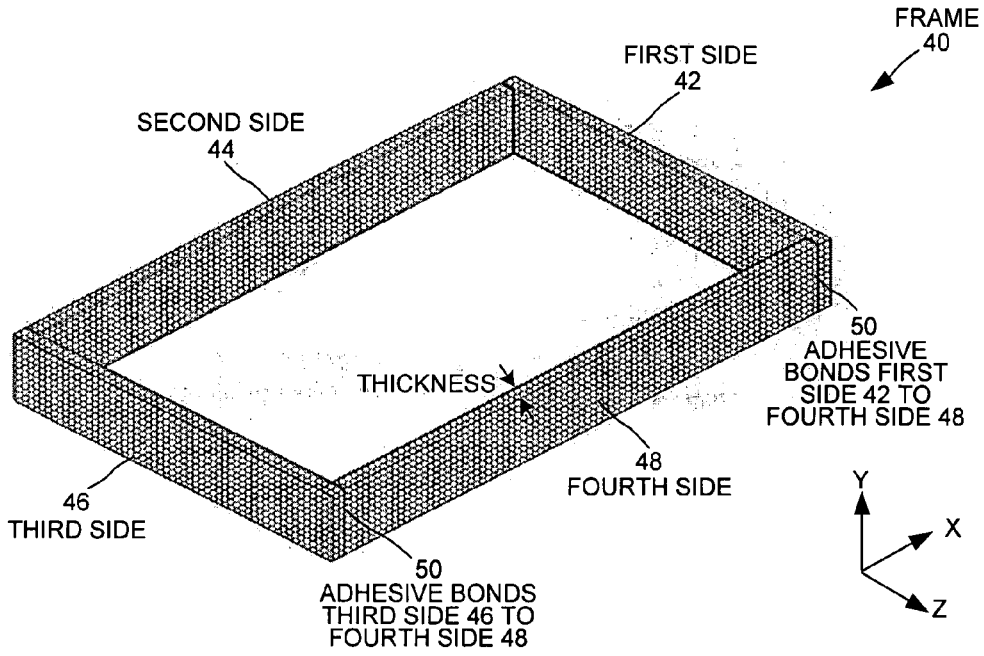
FIG. 4 is a perspective view of a frame in accordance with an embodiment.

FIG. 4 is a perspective view of a frame 40 in accordance with another embodiment. Frame 40 has a first side 42, a second side 44, a third side 46 and a fourth side 48. In one aspect, a rectangular strip of polyurethane foam is formed having a width (in the Y direction) of the width of each of first side 42, second side 44, third side 46 and fourth side 48 (all widths are the same) and having the length of at least of the combined lengths (in the X and Z directions) of first side 42, second side 44, third side 46 and fourth side 48. In one example, the density of the foam is approximately 0.8-3.0 pounds per cubic foot.

The piece of foam is cut so that four portions of foam result having the dimensions of first side 42, second side 44, third side 46 and fourth side 48. The sides are joined at the edges using an adhesive 50 such as, but not limited to, Styrene Butadiene Rubber (SBR) glue or urethane based glue to form frame 40 having the desired dimensions.

Frames 30 and 40 surround mattresses having various sizes (e.g., twin, full, queen, or king) and thicknesses. Accordingly, the dimensions of frames 30 and 40 in the X, Y and Z directions vary depending on the size of the mattress that frame 30 or 40 is to surround. The thickness of the frame can vary depending on the desired edge support provided for the mattress and/or the density of the frame.

Figure 5:
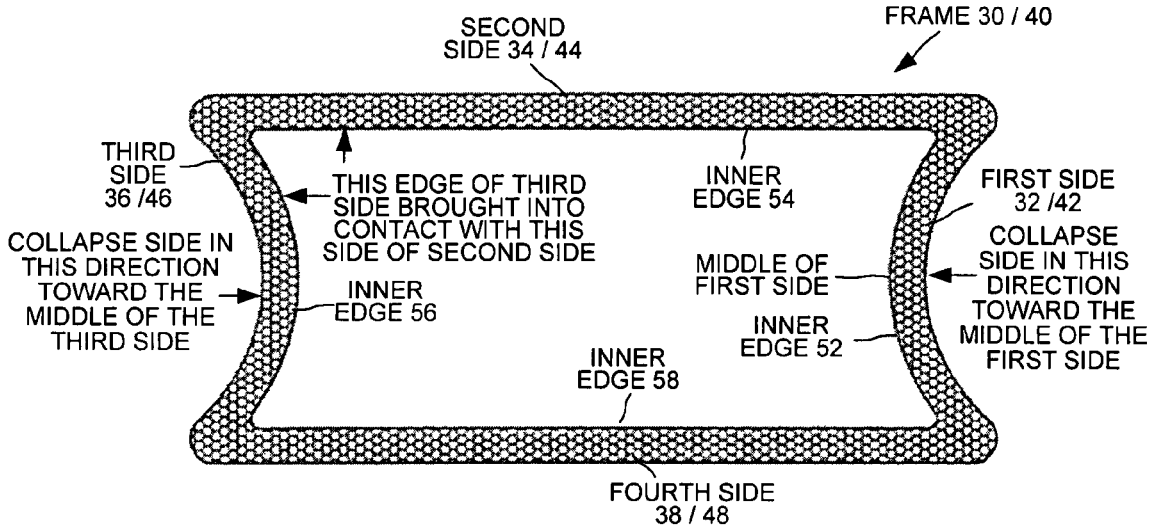
FIGS. 5-7 depict an example of how the shape of the frame is changed to reduce the size of a frame to a size suitable for transportation in accordance with an embodiment.
Figure 6:
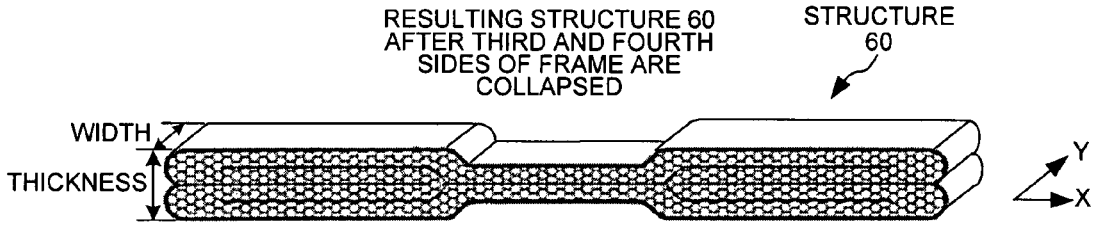
Figure 7:
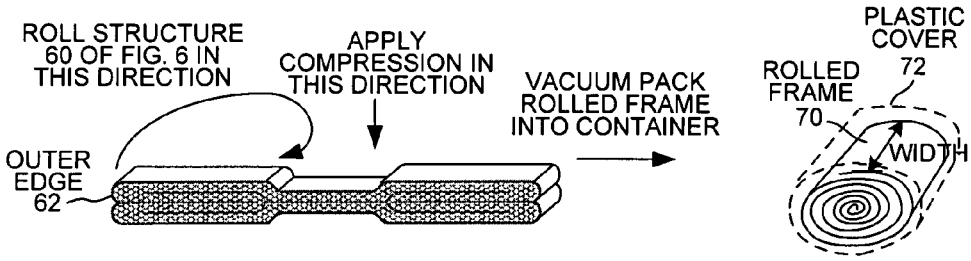

FIGS. 5-7 depict an example of how the shape of the frame is changed to reduce the size of a frame to a size suitable for transportation in accordance with an embodiment. FIG. 5 shows a top view of frame 30/40 when it is being manipulated to form the structure 60 of FIG. 6. Each of first side 32/42, second side 34/44, third side 36/46 and fourth side 38/48 have respective inner edges 52, 54, 56 and 58. In this example, inner edge 52 of first side 32/42 is bent from its middle in a U-shape so that straight sides of the U are placed into contact with inner edges 54 and 58. Similarly, inner edge 56 of third side 36/46 is bent from its middle in a U-shape so that straight sides of the U are placed into contact with inner edges 54 and 58. The resulting structure is shown in perspective view as structure 60 of FIG. 6. Structure 60 has a shape similar to a bow-tie.

For example, the thickness of structure 60 can be approximately seventy-five percent less than the combination of thicknesses of sides that are brought into contact. Other compression ratios, however, can also be used. For example, where four sides are stacked as in the left-hand side of structure 60, the resulting thickness is twenty-five percent of what the combined thicknesses of each of the four sides would have been.

FIG. 7 depicts an example of how structure 60 is shaped into a rolled frame 70. Structure 60 is rolled into a spiral starting at outer edge 62 while maintaining a constant width (the width is shown in FIG. 6). During rolling, structure 60 is also compressed. The rolled and compressed frame is vacuum packed into a plastic cover to form rolled frame 70 having plastic cover 72. The rolled frame 70 having plastic cover 72 is ready to be transported.

Figure 8:
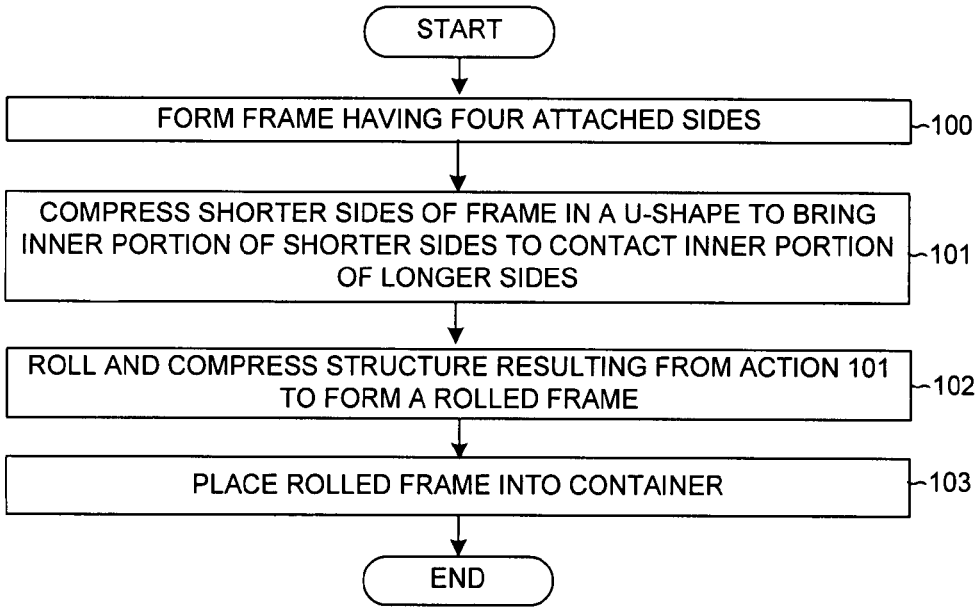
FIG. 8 is a flow chart of a suitable process to form a frame having a suitable size for transportation in accordance with an embodiment.

FIG. 8 is a flow chart of a suitable process to form a frame having a suitable size for transportation in accordance with an embodiment. In action 100, a frame having four attached sides is formed. For example, the frame can be formed as described with regard to FIG. 3 or FIG. 4. In action 101, the shorter sides of the frame are compressed in a U-shape so that inner portions of the shorter side contact the inner portions of the longer sides. The resulting structure is bow-tie shaped and shown in FIG. 6. In action 102, the structure resulting from action 101 is rolled and compressed. In action 103, the rolled frame is vacuum packed into a container such as a plastic bag.

Figure 9:
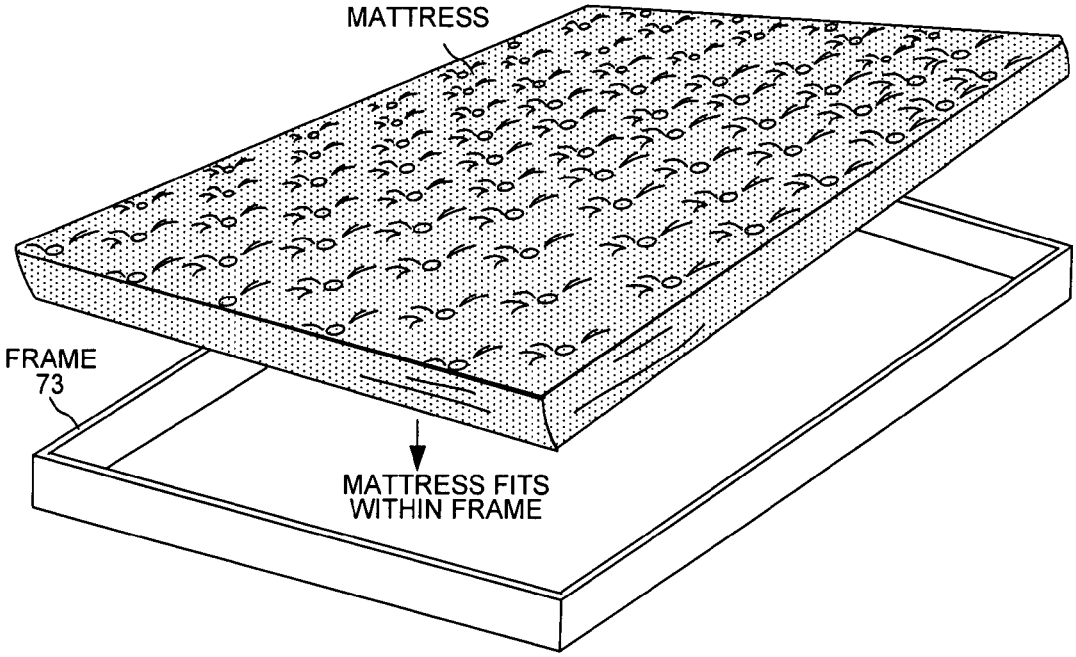
FIG. 9 is an example of a placement of a mattress into a frame so that the frame surrounds the mattress in accordance with an embodiment.

FIG. 9 is an example of a placement of a mattress into a frame 73 so that the frame surrounds the mattress in accordance with an embodiment. The recipient of the rolled frame can remove frame 73 from its packaging and form a frame without assembly. The user can merely unpack the package and frame 73 can restore to its intended inflated state naturally without any extra operation. The mattress is placed within frame 73.

Figure 11:
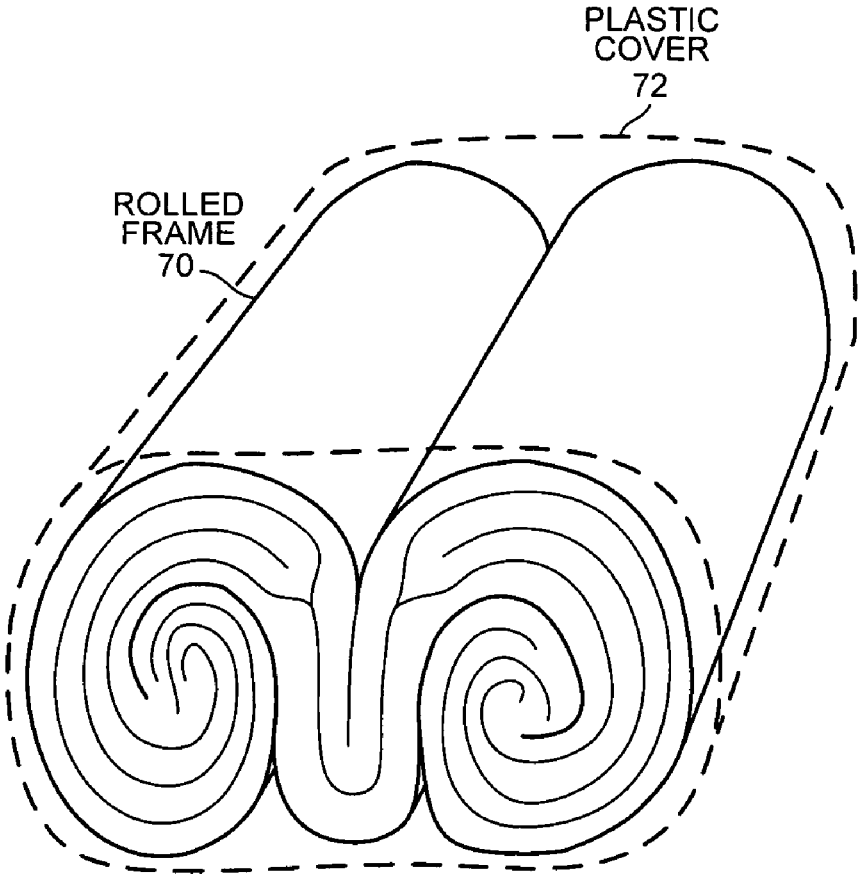
FIG. 11 is a perspective view of a rolled frame that has a cross-sectional M-shape.

Although certain specific exemplary embodiments are described above in order to illustrate the invention, the invention is not limited to the specific embodiments. Other types of foam and material can be used such as material that is bendable and compressible without breaking or permanently deforming but memorizes its shape so that it restores to its shape prior to being bent or compressed. For example, alternative materials to form one or more sides of the frame can include, but are not limited to, sponge, hydrofluoroalkane (HFA) products, Expanded Polystyrene (EPS), extruded polystyrene foam (XPS), toluene-diisocyanate (TDI) base, and methylene diisocynate (MDI). For example, the shape of rolled frame 70 can be M-shaped, as shown in FIG. 11, or ram horn shaped (two spirals) as described in U.S. patent application Ser. No. 11/786,854, "Rolled Memory Foam Bedding Article Having A Plurality Of Roll Portions", inventor Suk Kan Oh, filed Apr. 13, 2007, which is incorporated by reference herein in its entirety. Accordingly, various modifications, adaptations, and combinations of various features of the described embodiments can be practiced without departing from the scope of the invention as set forth in the claims.

What is claimed is:

1. A method comprising:

forming a four sided mattress frame with a continuous piece of foam, wherein each of the four sides has an inner edge and wherein the mattress frame includes two shorter sides and two longer sides; and making a compressed frame by folding each of the shorter sides of the frame into a U shape so that inner edges of the shorter sides contact inner edges of the longer sides.

2. The method of claim 1, wherein the folding forms a bow-tie shaped structure.

3. The method of claim 1, further comprising:

rolling the compressed frame into a spiral while maintaining a width of the frame; and vacuum packing the rolled frame into a container.

4. The method of claim 3, wherein removing the rolled and compressed frame from the container allows the frame to expand.

5. The method of claim 4, wherein the container is a plastic cover.

6. The method of claim 4, wherein the frame reforms without assembly when the frame is allowed to expand.

7. The method of claim 1, wherein the compressed frame has two ends, further comprising:

rolling each end of the compressed frame to form an M-shape while maintaining a width of the frame; and vacuum packing the rolled frame into a container.

8. The method of claim 1, wherein the continuous piece of foam is formed by bonding edges of separate pieces of foam.

9. The method of claim 1, wherein the frame comprises polyurethane.

10. The method of claim 1, wherein the forming comprises:

forming the continuous piece of foam using a mold.

11. The method of claim 1, wherein the forming comprises:

forming at least two sides of the frame; and joining the at least two sides using an adhesive to form the frame.

12. The method of claim 11, wherein the joining comprises using urethane based glue.

13. The method of claim 1, wherein the frame requires no assembly by a user.

14. The method of claim 1, further comprising:

further compressing the compressed frame such that the folded shorter sides and longer sides have a combined thickness that is about twenty-five percent of the combined thickness of the shorter sides and longer sides before the making the compressed frame.

15. The method of claim 1, wherein each of the four sides is at least as wide as a mattress is thick.

16. A method comprising:

forming a mattress frame with a continuous piece of foam, wherein the mattress frame includes two shorter sides and two longer sides, wherein each of the sides has an inner edge, and wherein the mattress frame has a center opening;

folding each of the shorter sides of the mattress frame into the center opening so that the inner edges of the shorter sides contact the inner edges of the longer sides;

compressing the folded sides of the mattress frame;

rolling the compressed and folded mattress frame into a spiral; and vacuum packing the rolled mattress frame in a plastic bag.

17. The method of claim 16, further comprising:

including user instructions with the rolled mattress frame on how the mattress frame can be placed in order to surround a mattress.

18. The method of claim 16, wherein the mattress frame has a width in a Y-direction that corresponds to a thickness of a mattress that the mattress frame is to surround.

19. The method of claim 16, wherein the continuous piece of foam is formed by injecting chemicals into a mold and without joining individual sides.

* * * * *